US005984739A

United States Patent [19]

Donahue

[11] Patent Number: 5,984,739

[45] Date of Patent: Nov. 16, 1999

[54] DETACHABLE PROPULSION UNIT FOR A SCUBA TANK

[76] Inventor: Christopher Donahue, 7243 Culp Ter., Bethalto, Ill. 62010

[21] Appl. No.: 09/218,354

[22] Filed: Dec. 22, 1998

Related U.S. Application Data

[60] Provisional application No. 60/068,537, Dec. 23, 1997.

[51] Int. Cl.[6] ..... B60L 9/00

[52] U.S. Cl. ..... 440/6; 114/315

[58] Field of Search ..... 440/6; 114/315

[56] References Cited

U.S. PATENT DOCUMENTS 3,916,814 11/1975 Bardoni et al. ..... 114/315
3,995,578 12/1976 McCullough ..... 440/6
4,467,742 8/1984 Duboy ..... 114/315
4,843,998 7/1989 Parker ..... 114/315

*Primary Examiner*—Jesus D. Sotelo
*Attorney, Agent, or Firm*—Greensfelder, Hemker & Gale, P.C.

[57] ABSTRACT

A detachable propulsion unit for a scuba diver's air tank is provided to create a hands-free personal propulsion device. The invention comprises an air tank receiving boot member, a propeller motor, power supply and quick connect straps for attachment to the diver. The unit may be quickly released from the air tank in the event of an emergency. A buoyancy and trim control air bag is also provided to help the diver maintain horizontal trim in the water and to control ballast. If desired, an attachment is provided to allow conversion into a hand held propulsion unit separate from connection with the air tank.

17 Claims, 13 Drawing Sheets

DETACHABLE PROPULSION UNIT FOR A SCUBA TANK

This application claims the priority benefit of U.S. Provisional Application No. 60/068,537, filed Dec. 23, 1997.

BACKGROUND OF THE INVENTION

This invention relates to the field of scuba diving. It has been known in the prior art of scuba to use propulsion devices to increase speed and distance without sacrificing air consumption. It is also known that hand held propulsion devices for use with scuba do exist. However, the prior art of using a hand held unit encounters a number of difficulties, one being that a diver must continuously use his hands to hold on to the propulsion device unit for steering. This creates undue stress and fatigue in the shoulders and arms. A hand held unit would obviously be impractical for use by a diver having an arm handicap. Furthermore when the diver comes to rest in the water, he must either hold on to the unit or clamp it between his legs, this also being cumbersome and inconvenient. Another drawback is that, by having to hold on to the unit at all times, the diver does not have any freedom with his hands to carry out other activities. This inhibits the diver from enjoying other underwater interests such as photography, shell collecting, or spearfishing. A further drawback of the hand held propulsion devices is that the propeller will create a backwash behind the unit, which may cause some hindrance to the diver.

There is accordingly a need for a scuba propulsion system which would enable a diver to enjoy hands-free operation so that propulsion could be effected without hindering the diver's other activities. While hands-free operation might suggest direct connection of the propulsion means to the diver, other factors must be considered in determining the manner of connection to the diver. For instance, it is important to maintain diver buoyancy and also diver safety. The presence of the propulsion system should not interfere with normal diving operations nor prevent a diver from easy maneuvering in the water. It would be desirable for the propulsion system to be situated such that the propeller backwash not hinder the diver. Further, there should be a capability to rapidly jettison the propulsion equipment if the diver needs to surface in an emergency.

SUMMARY OF THE INVENTION

This invention provides a propulsion system for mounting on a scuba air tank. It comprises a shell which is removably attached to a standard scuba air tank, a propeller motor mounted on the shell, a power supply for the motor, and a remote control for operating the speed of the motor. By attaching a motor to the air tank, a diver can effect hands-free propulsion underwater. The propulsion system is attached to the tank and diver using quick connect/disconnect buckles to enable easy installation and removal. This type of buckle also allows for the diver to rapidly jettison the propulsion system in the event of an emergency. The remote control, connected to the motor by a water-proof cord, allows the diver to turn the unit on and off and to control the speed of the motor.

The propulsion system also comes equipped with a buoyancy and diver trim control device for maintaining one's horizontal position while maneuvering underwater. The buoyancy and trim control device comprises an air bag disposed on the system such that it can also serve as padding to distribute the weight of the motor over the diver's lower back. The air bag is provided with an air line so that the diver can inflate and deflate as necessary to effect the proper buoyancy level.

The propulsion system may further be configured so that the capability to turn underwater is enhanced. This configuration comprises the motor being mounted such that it swivels in the horizontal plane about its axis of connection to the mounting shell. One or more springs are attached to the motor which keep the motor normally aligned with the orientation of the scuba tank, while bringing the motor back into alignment when displaced as a result of turning in the water. The diver need only move in the direction he wants to go and the unit will turn in cooperation with him.

If desired, the propulsion system may be converted into a hand-held mode. A separate plug member having handles is inserted and secured into the boot shell. The unit is inverted during use such that the buoyancy and trim control bag, which lighten the weight of the unit when inflated, is disposed at the top of the unit.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
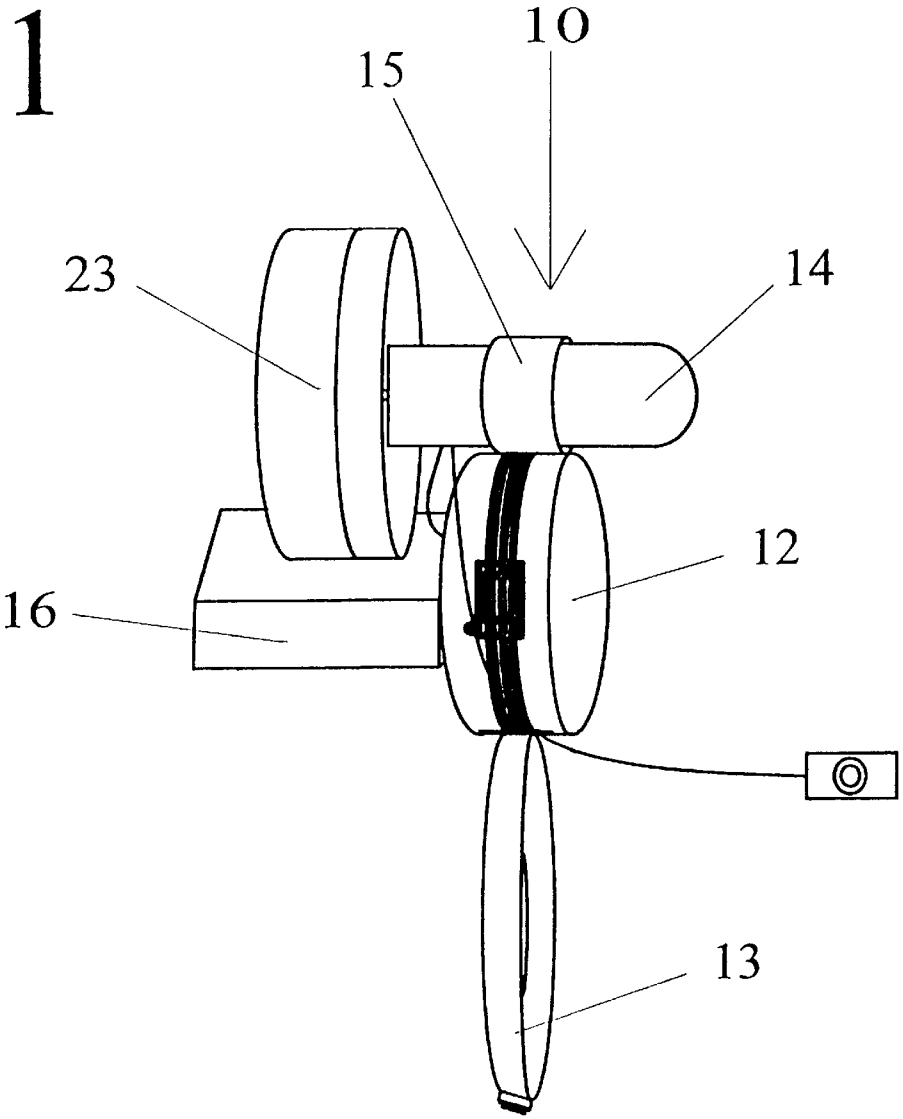
FIG. 1 is a perspective view of the propulsion system.
Figure 2:
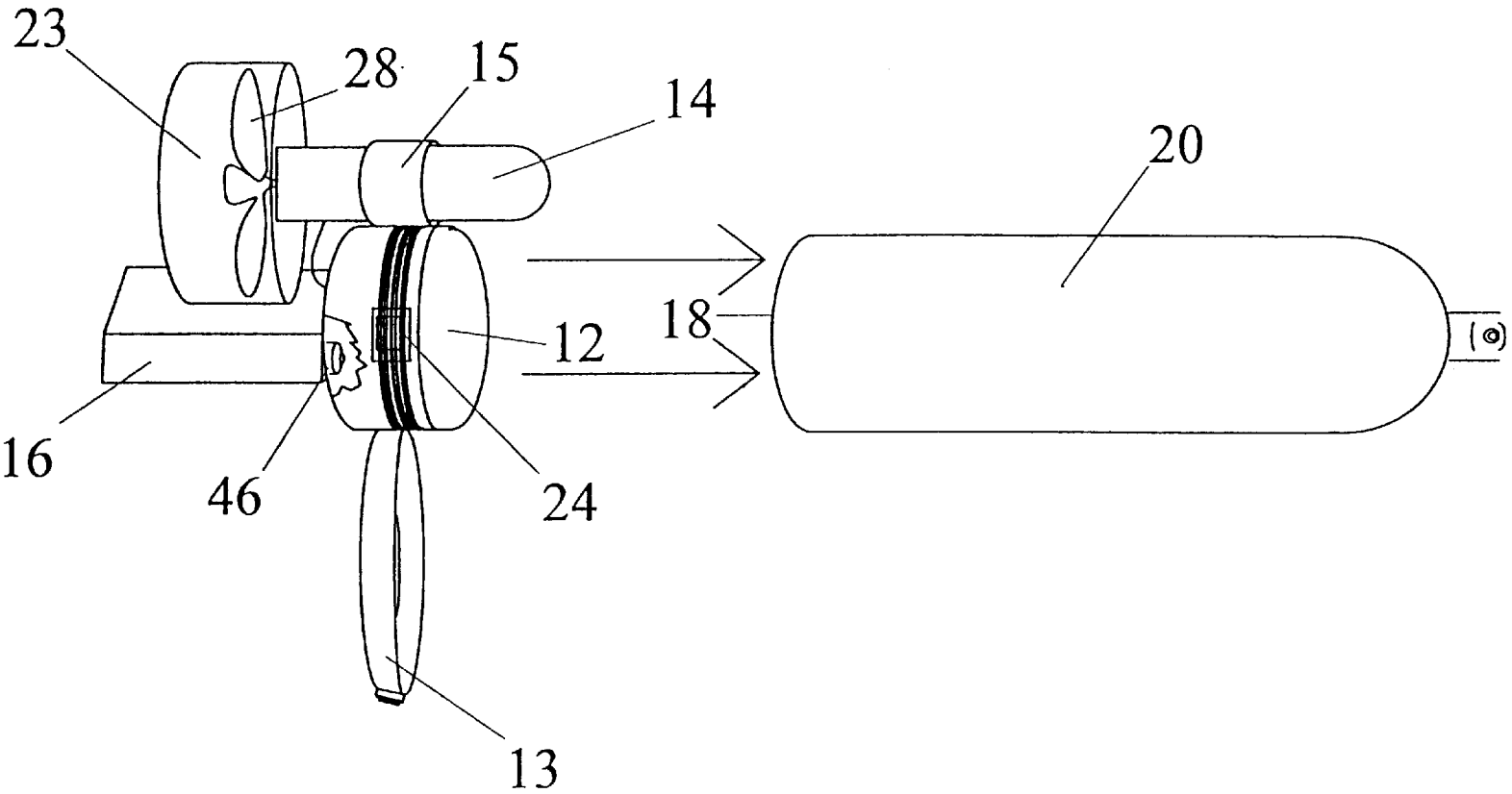
FIG. 2 is a perspective view of the propulsion system, with the air tank receiving boot member partially broken away, and a scuba air tank.
Figure 3:
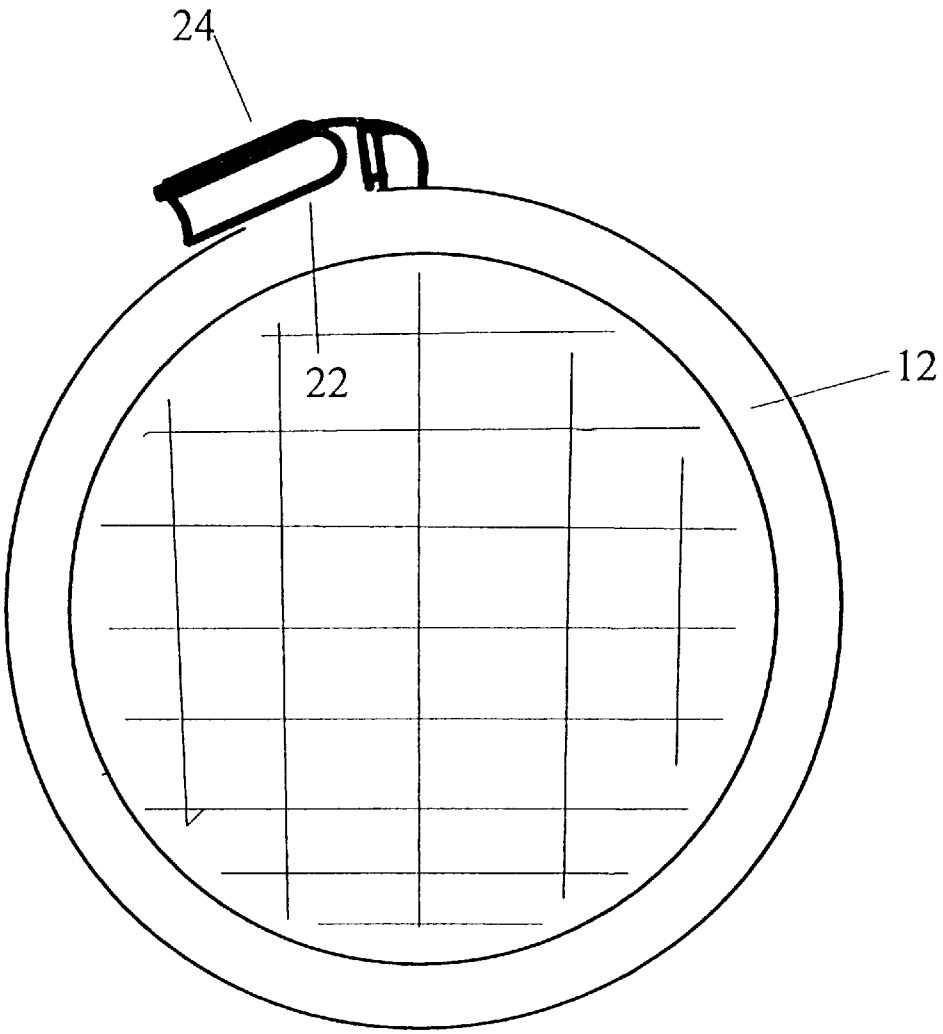
FIG. 3 is a top plan view of the air tank receiving boot member.

The propulsion system of the present invention is referred to generally by the reference numeral 10 as shown in FIG. 1. It comprises a shell, or boot member, 12 for receiving a scuba air tank 20, a motor 14, a power supply 16, and a support belt 13. Boot member 12 is cylindrical and cup-shaped to receive the bottom end 18 of a standard scuba tank 20 as shown in FIG. 2. Boot member 12 is composed of plastic or other material which is sturdy yet light in weight. It is necessary to ensure a snug fit of the tank within the boot housing to prevent dislodgement of the tank during use. As shown in FIG. 3, boot member 12 can be provided with a gap 22 which allows the housing to be expanded to easily receive the air tank. Gap 22 is provided with a closing mechanism to tighten the boot housing wall around the scuba tank. A cam lock 24, which may be a snap lock for quick connect/disconnect, is preferably used as it will allow for rapid jettisoning of the propulsion system from the air tank. A separate strap encircling the boot shell with a quick release buckle may also be employed to assist in drawing the wall of the shell tightly around the tank. Because of its weight and specific placement, the propulsion unit can act, and take the place of, the standard weight belt used by divers to counter the buoyancy effects of the diver and his various equipment. In this regard, it is therefore important that the propulsion unit be rapidly detachable in the event of an emergency so that the diver can surface quickly. Accordingly, cam lock 24 can be quickly unlatched so that boot housing shell 12 can fall away from the air tank.

Figure 15:
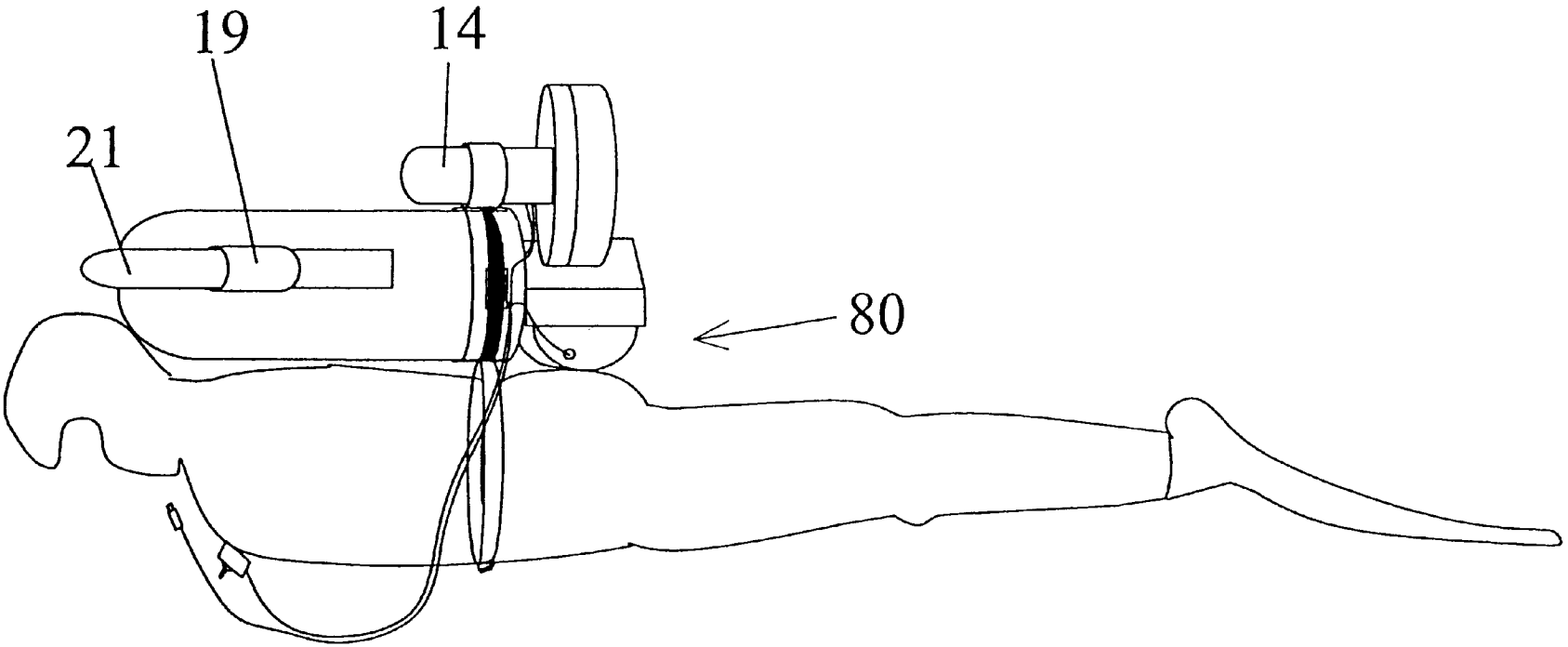
FIG. 15 is a perspective view showing the placement of an additional power supply on the tank.

Motor 14 is disposed adjacently to boot housing shell 12 such that motor and propeller 28 are disposed behind the air tank at a position which will not hinder the movement of the diver. A propeller guard 23 is placed around the propeller fins to protect the diver. The motor may be a standard electrical or fuel powered motor/propeller of the type which is commonly available in marine shops. A mounting ring 15, connected to boot housing shell 12, is used to fasten motor 14 to the propulsion unit with clamps or other fasteners. Power supply compartment 17 is placed to the rear of boot housing shell 12, and receives a power supply such as a battery. If necessary, an auxiliary battery supply can be piggybacked on to the propulsion unit at an appropriate available place, such as shown in FIG. 15. A bracket 19 is mounted on tank 20 which enables auxiliary power supply 21 to be inserted therein.

Figure 5:
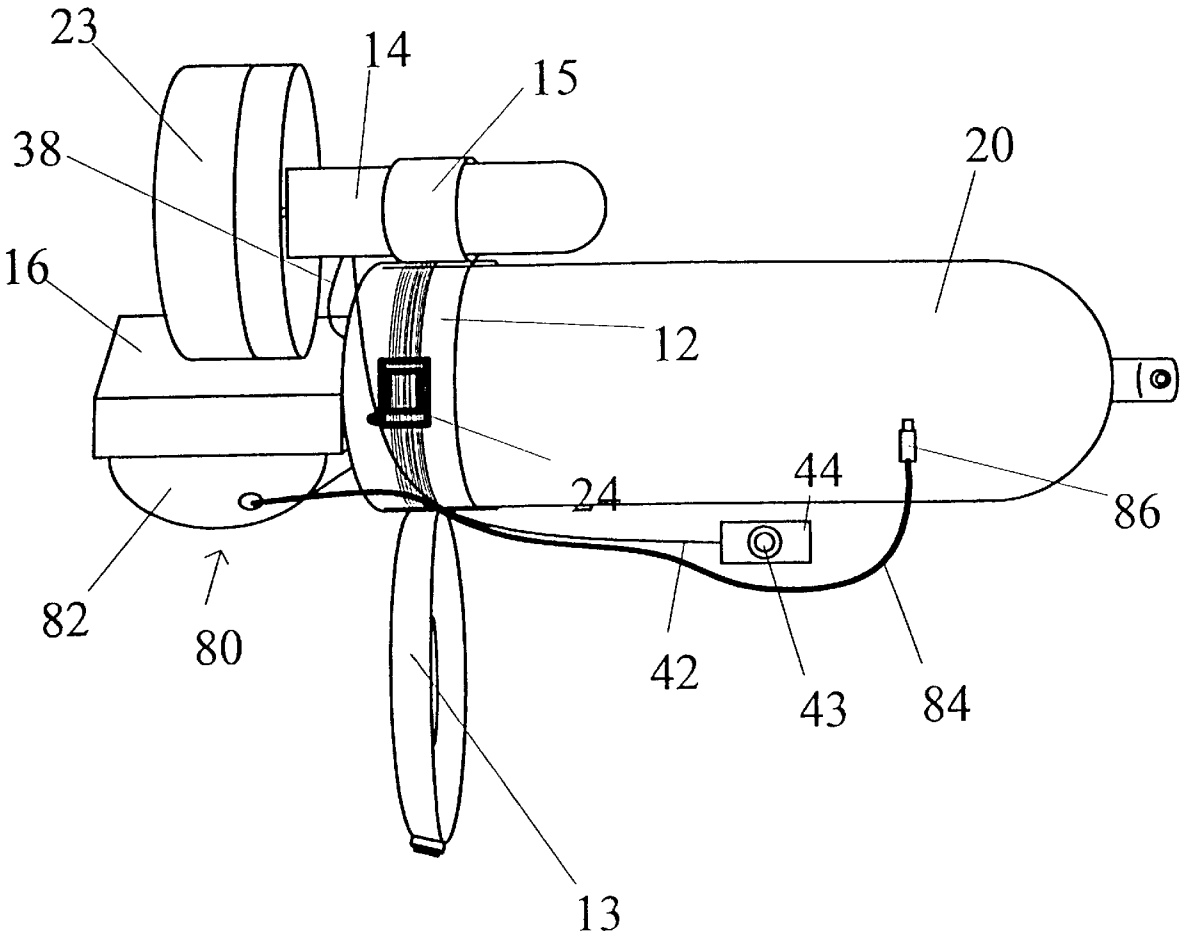
FIG. 5 is a perspective view of the propulsion system attached to a scuba air tank, with the buoyancy/trim control bag.

The motor 14 receives power from the battery power supply through cord 38 as shown in FIG. 5 using a waterproof connector plug. A power control cord 42 leading from the motor terminates in a control panel 44 which is positioned within reach of the diver, preferably in near proximity to the standard air regulator controls for the scuba tanks. The control panel is equipped with switches 41 and 43 for on-off and speed control functions, respectively, as is understood by those skilled in the art. In the event that the propulsion unit must be jettisoned or if the air tank becomes accidentally dislodged during operation, a safety stop switch 46 as shown in FIG. 2 is provided. The safety stop switch is located in the bottom wall of boot housing shell 12 and functions to shut off the power to the motor when the scuba air tank 20 is disengaged from within the housing shell. The safety switch can comprise a simple circuit element in connection with the power supply that only allows current to flow within the circuit when contact is maintained with the scuba tank, and breaks the circuit when the contact is broken.

The propulsion unit may further be provided with a buoyancy/trim control device 80. This device, which is shown in FIG. 5, comprises an air bag 82 disposed below the power supply compartment 16 and behind boot shell housing 12. An air line 84 having a mouthpiece 86 enables the diver to blow into the air line to inflate air bag 82 to effect an increased buoyancy to the propulsion unit. Release valves (not shown) are provided in line 84 to deflate the air bag when necessary. When inflated, air bag 82 also serves as padding to cushion the diver's lower back area from contact by the propulsion unit hardware.

Figure 6:
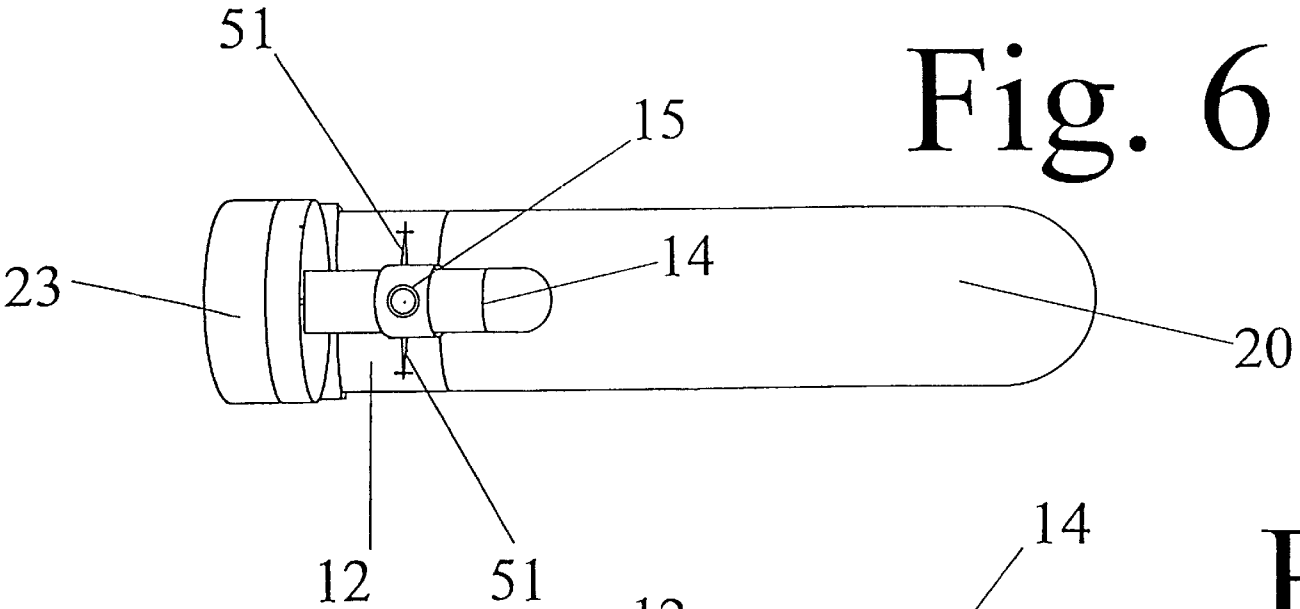
FIG. 6 is a top plan view of the propulsion system attached to a scuba tank, showing a first embodiment of the steering system.
Figure 7:
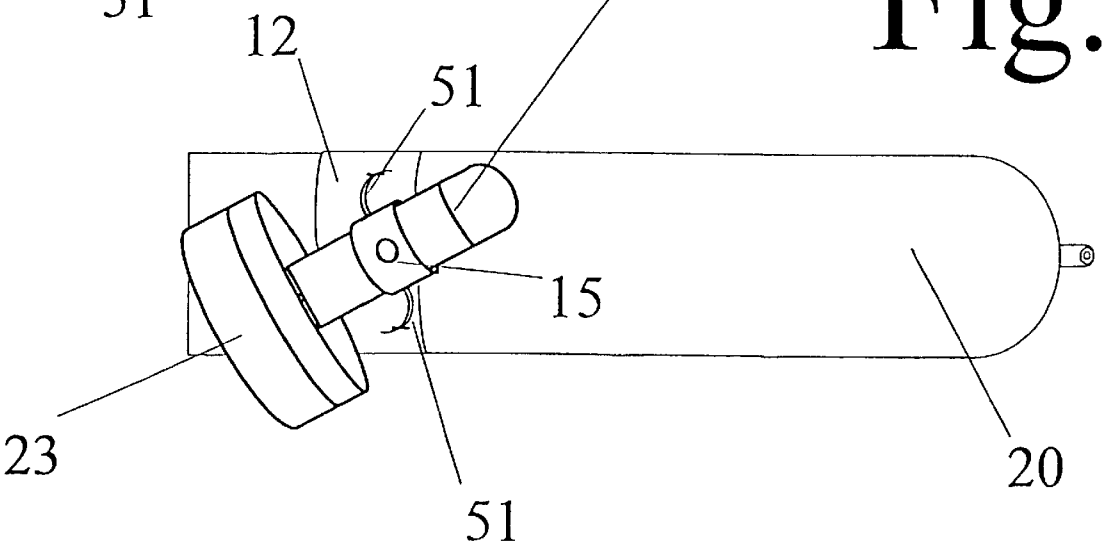
FIG. 7 is a top plan view of the first embodiment of the steering system, with the motor pivoted as if in a turn.
Figure 8:
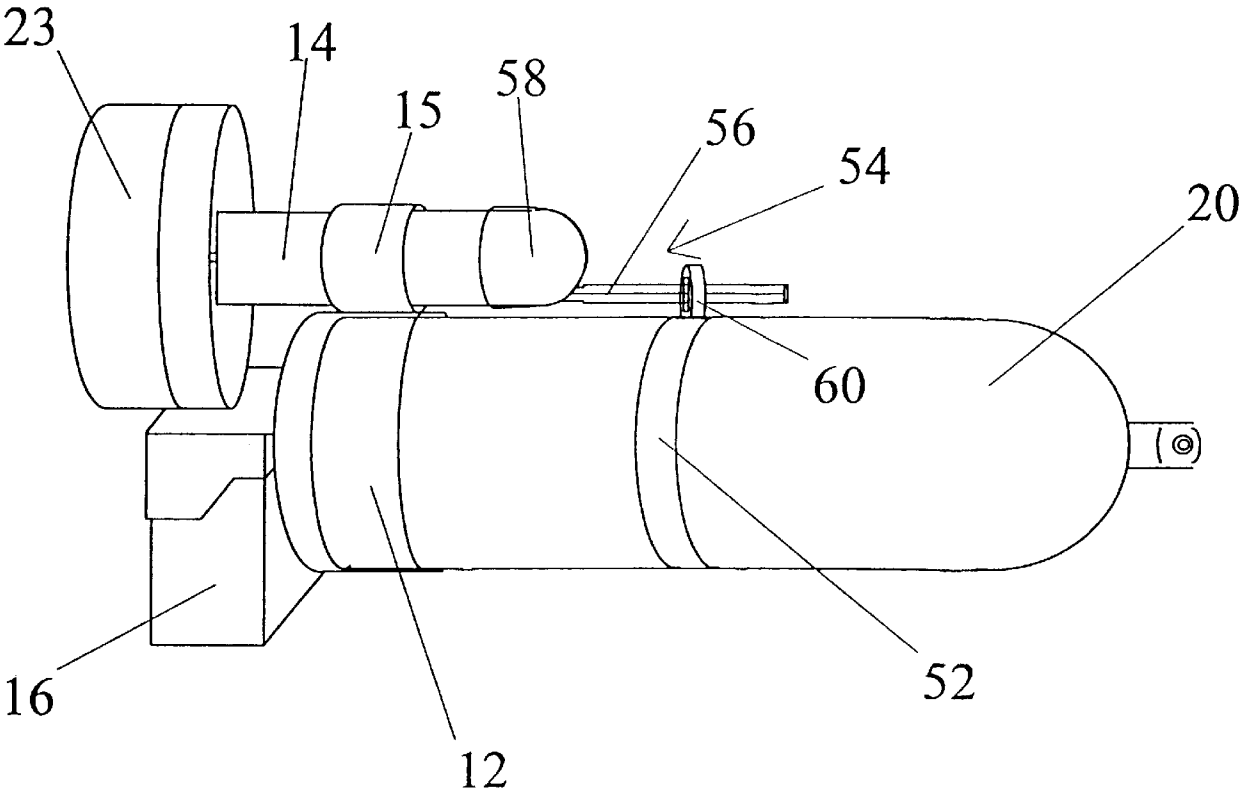
FIG. 8 is a perspective view of a second embodiment of the steering system.

The propulsion unit may further be provided with automatic steering devices. One embodiment of the steering adjuster is shown in FIGS. 6 and 7 and is comprised of a pair of spring members 51 mounted on either side of motor 14. In this embodiment, motor 14 is mounted such that it is able to rotate in the horizontal plane about its axis of connection. Spring members 51 have a sufficient tension load such that they urge motor 14 back into axial alignment with the scuba air tank when the motor pivots about its axis as shown in FIG. 7. A further embodiment of the steering adjuster, as shown in FIG. 8, comprises an air tank engaging bracket 52 and a steering spring 54. The bracket 52 may be circular or partially circular such that it can engage air tank 20 in a sliding relationship to be positioned at various locations along the length of the air tank. The bracket 52 may be resiliently biased, or a tightening clamp should be provided, so that it can be secured in place on the air tank. Steering spring 54 comprises a flexible rod or spring 56 having a mounting cup 58 which is placed over a front end of motor 14. Flexible rod 56 extends along the air tank and is slidably received within journal 60. The sliding relationship is necessary to allow adjustment in the tension load of rod 56 and to enable the propulsion unit to be able to slide off from the air tank when necessary. To adjust the tension load of rod 56, bracket 52 is moved along the air tank. For an increase in tension, the bracket is moved closer to the motor such that journal 60 is moved down along rod 56; for a decrease in tension, the bracket is moved away from the motor such that journal 60 is moved up along rod 56.

Figure 13:
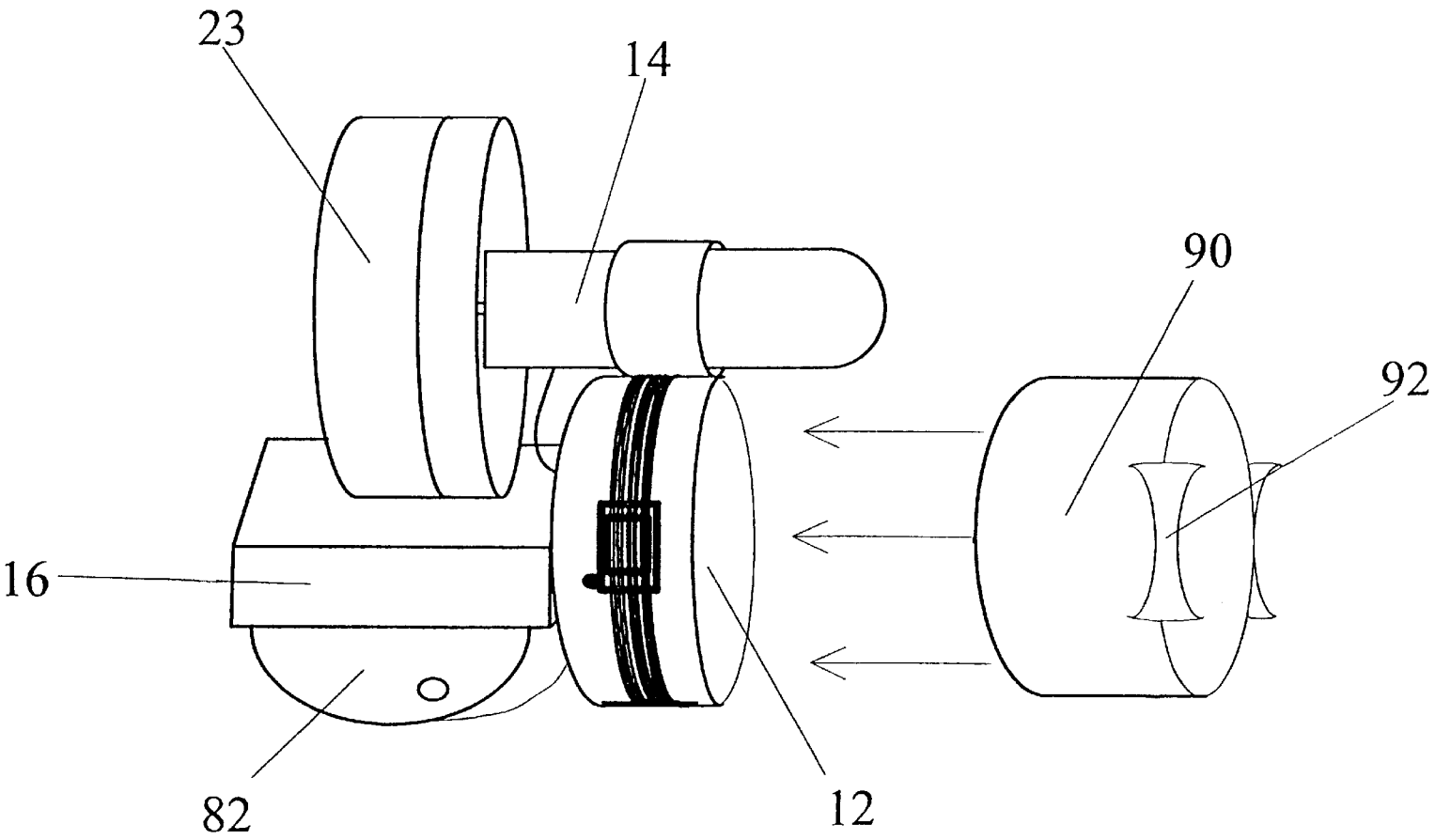
FIG. 13 is a perspective view of a further embodiment of the propulsion system which features the capability of conversion into a hand held propulsion unit.
Figure 14:
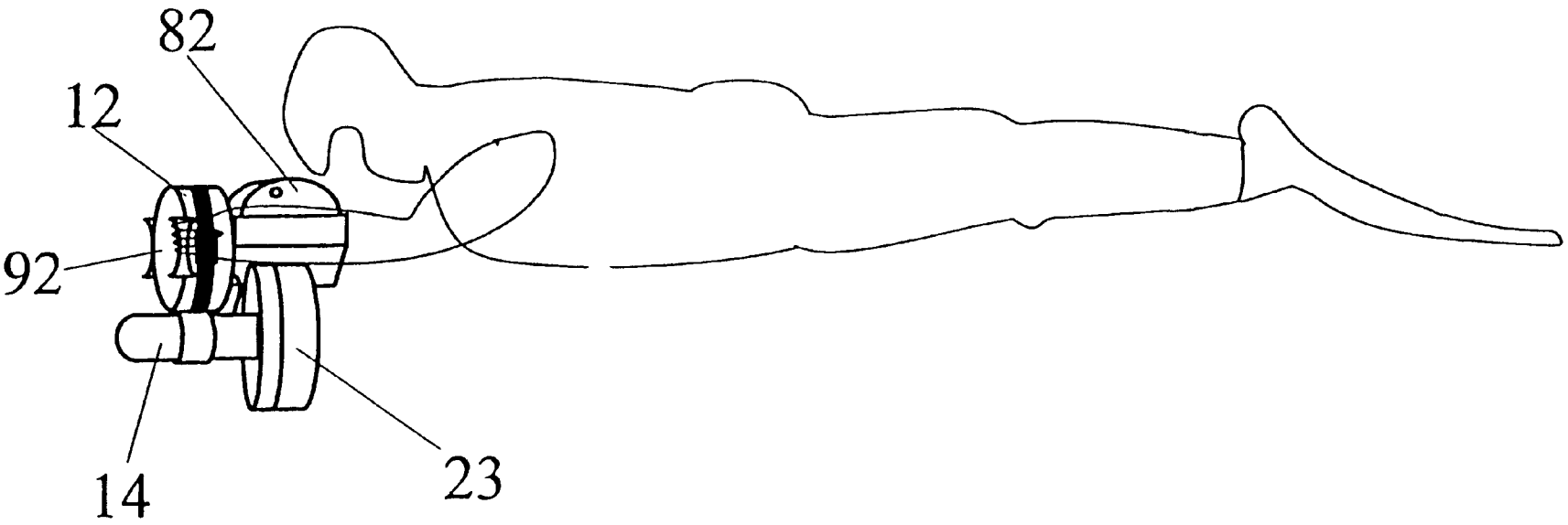
FIG. 14 is a perspective view of a diver using the hand held propulsion unit.

If desired, the propulsion unit may be converted into a hand held device. As shown in FIG. 13, a plug member 90 having handles 92 is provided for placement in boot shell housing 12 in the same manner as an air tank. Once inserted, the propulsion unit is inverted so that the propeller motor is disposed downward and air bag 82 is positioned on top, as shown in FIG. 14. The air bag is inflated as necessary to maintain buoyancy of the unit so that it does not become too heavy for the diver.

USE

The propulsion unit of the instant invention is very simply employed to effect hands free underwater propulsion for a diver. The unit is sufficiently light weight so that it may be attached to the diver either before he gets in the water or while he is in the water. FIG. 5 shows the basic operational components of the preferred embodiment of the invention. The boot shell housing is placed and secured over the end of scuba tank 20. When connected to the air tank, the unit is the attached to the diver by support belt 13, which is secured by quick release buckles. Power control cord 42 with power control panel 44 is extended so that it terminates around the diver's chest, where the other standard dive regulators would be positioned. Cord 42 is attached to quick release buckle 24 so that the diver is able to disengage and quickly jettison the unit from the air tank in the event of an emergency. When the tank disengages from boot shell 12 and contact with safety stop switch 46 is removed, as shown in FIG. 2, the power circuit is broken and the motor will stop.

Figure 12:
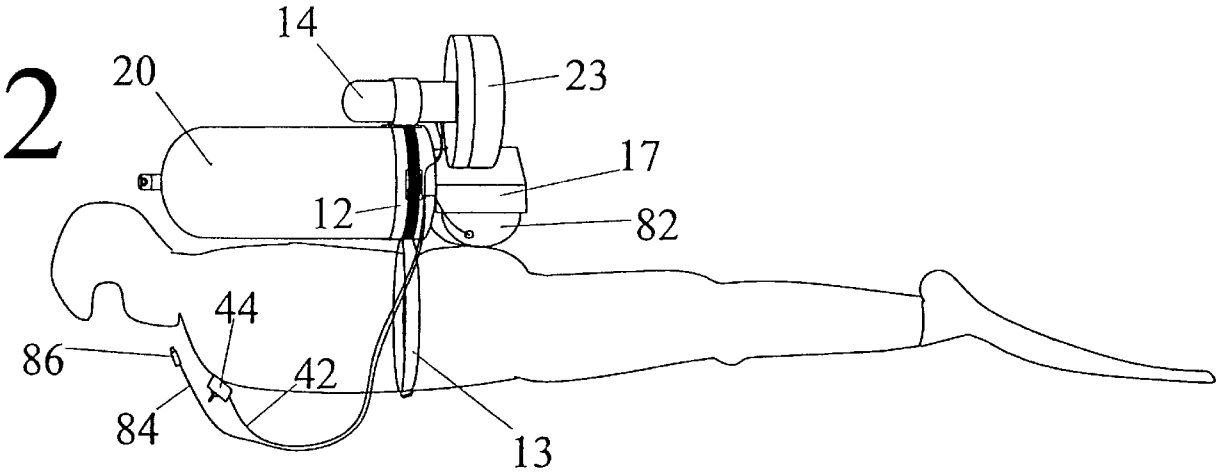
FIG. 12 is a perspective view of the propulsion system attached to a diver, with the buoyancy/trim control bag in an inflated state.
Figure 11:
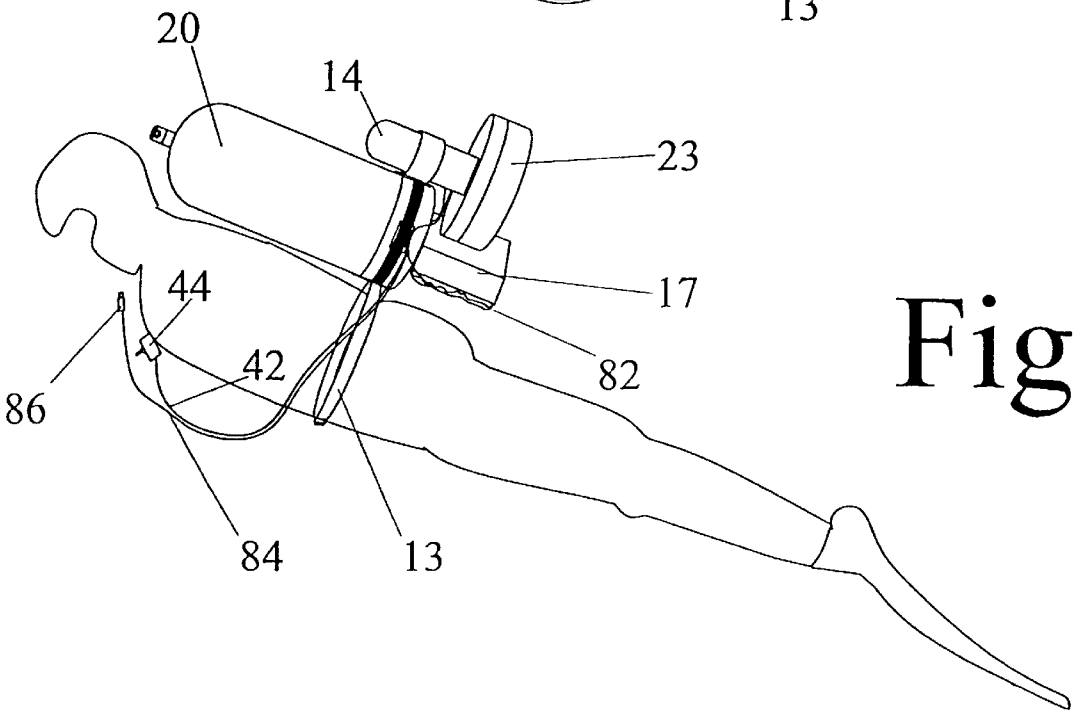
FIG. 11 is a perspective view of the propulsion system attached to a diver, with the buoyancy/trim control bag in a deflated state.

Air line 84 is also disposed within easy reach of the diver so that air bag 82 may be inflated to regulate buoyancy and control the trim of the diver's body. When air bag 82 is deflated, the diver's body will tend to maintain an inclined position, as shown in FIG. 11, which may tend to hinder the diver's maneuverability. By inflating air bag 82, the unit will attain a certain buoyant state and lift the diver's lower back and legs as shown in FIG. 12. As trim control device 80 addresses buoyancy issues, so does the addition of supplemental power supplies. The placement of an additional power source on the tank as in FIG. 15 serves to also function as a counterweight, and its positioning contributes to the effect on a diver's trim in the water. By moving auxiliary battery 21 within bracket 19, a different weight effect can be created depending upon the positioning of the battery. The further the battery is positioned forward, the greater the upward buoyancy effect will be on the trim control device 80. Conversely, the further the battery is positioned rearwardly, the lesser the upward buoyancy effect will be on the trim control device 80.

Figure 9:
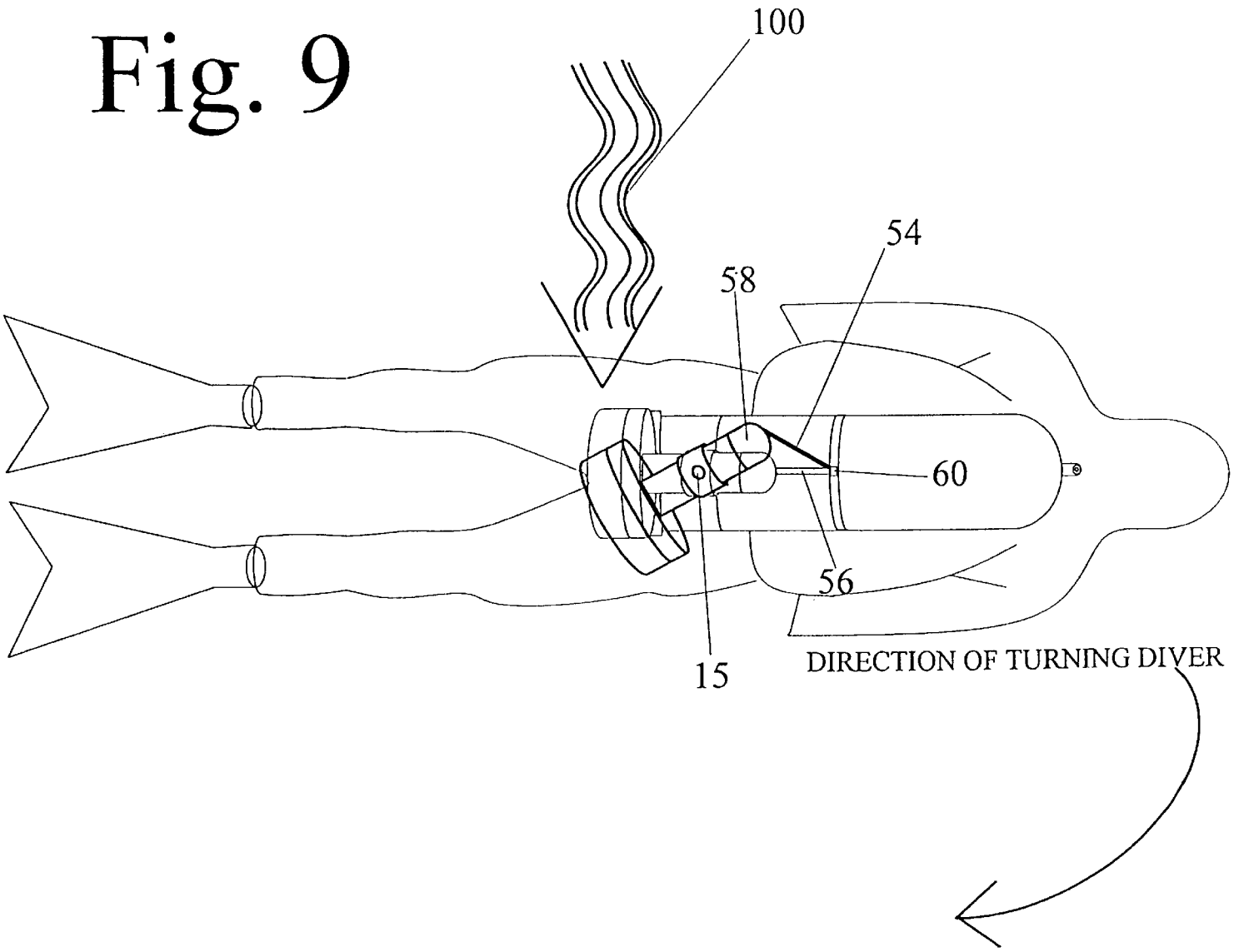
FIG. 9 is a top plan view of the propulsion system attached to a diver, showing the effect on the motor when the diver makes a turn underwater.

If an enhanced steering capability is desired, the motor can be mounted such that it rotates in the horizontal plane about its axis of connection, and the spring elements of FIGS. 6 or 8 may be attached. In this arrangement, the motor will yaw and swivel in response to the effective hydraulic force 100 created as the diver turns in the water as shown in FIG. 9, creating an initial enhanced turning effect which helps push the diver into the direction of the turn. After the diver's direction is straightened, the spring elements pull the motor back to center in alignment with the tank.

Figure 4:
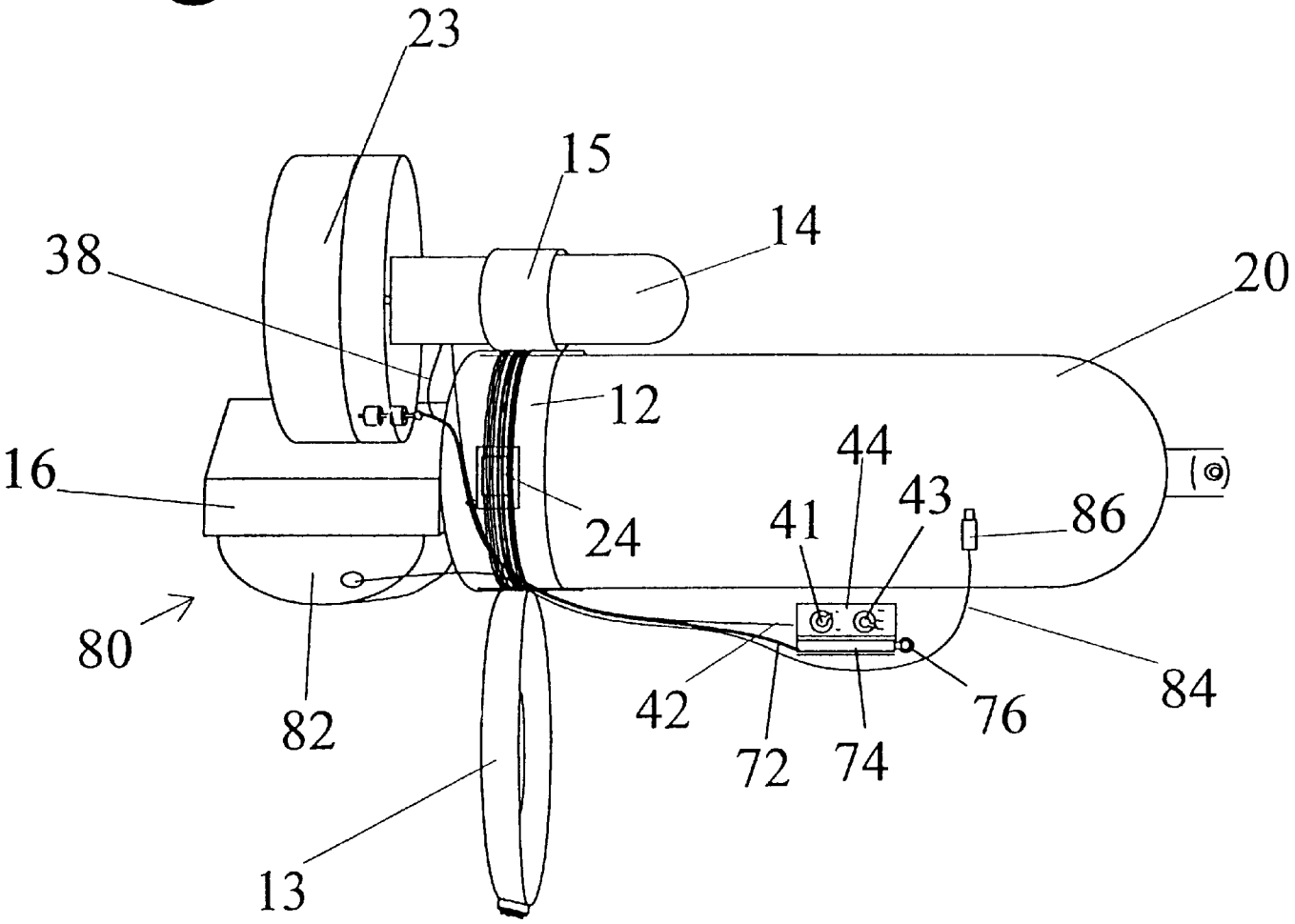
FIG. 4 is a perspective view of the propulsion system attached to a scuba air tank.
Figure 10:
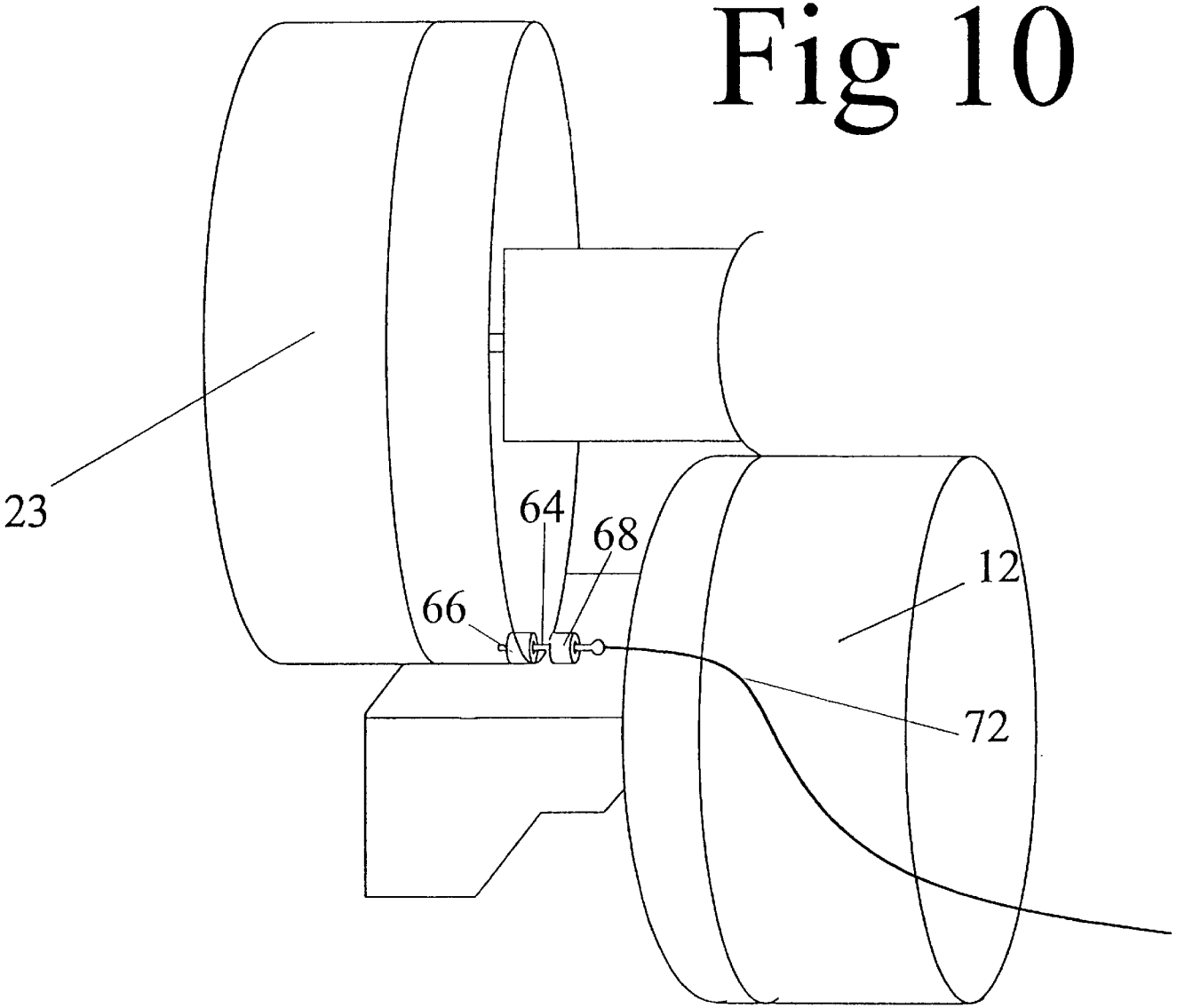
FIG. 10 is a perspective view of a locking mechanism to prevent the motor from pivoting.

The diver can remotely control the pivot mode of the motor by means of a lock mechanism 64 as shown in FIG. 10. Opposing collars 66 and 68 are welded on the inside of the propeller guard ring 23 and the top of the battery compartment 17, respectively. Retaining pin 70 is slidably received within collars 66 and 68. When the pin is placed through both collars, the motor is locked into place; when pin 70 is removed from collar 66, the motor is free to swivel. Pin 70 can be remotely controlled by the diver by means of cable 72 connected at one end to the head of pin 70 and its other end terminating in control panel 44. A slide rod 74 with thumb ring 76, as shown in FIG. 4, is connected to cable 72 for easy manipulation by the diver for opening and closing locking mechanism 64.

The detachable propulsion unit of the present invention affords the diver hands free locomotion in the water. The placement of the propulsion unit at the rear of the diver has additional advantages. For instance, the backwash from the propeller will not come into contact with the diver, but instead trails the diver so as not to cause turbulence which he must pass through. Also, it enables the diver to maintain his head above water, if necessary, while the motor remains below the surface. This feature further enables a diver to float on his back on the surface while being propelled. In this manner, the propulsion unit will remain underwater to a sufficient degree to achieve propulsion, yet allow the diver to remain at the surface of the water.

Various changes and modifications may be made within this invention as will be apparent to those skilled in the art. Such changes and modifications are within the scope and teaching of this invention.

What is claimed is:

1. A propulsion system attachment for mounting on a scuba air tank, said propulsion attachment comprising:

an air tank receiving boot member, a propeller motor, a power supply for said motor, a motor power control, and a belt support strap, said air tank receiving boot member being adapted to fit onto said air tank, said propeller motor being mounted to said air tank receiving boot member such that a propulsion system is created, said motor power control adapted to regulate said propeller motor to effect propulsive movement underwater, said belt support strap being fastened to said air tank receiving boot member, said belt support strap serving to attach said propulsion system onto a user.

2. The propulsion system attachment of claim 1 in which said air tank receiving boot member is removably attached to said air tank, and said belt support strap has a quick connect buckle, whereby said propulsion system attachment is capable of being rapidly jettisoned by said user.

3. The propulsion system attachment of claim 2 in which said air tank receiving boot member comprises a cylindrical shell, said shell having a circumference slightly less than that of said air tank, a slit being disposed in a wall of said shell such that said shell is capable of being slightly pulled apart to receive said air tank therein, said shell having a quick connect buckle to draw said wall of said shell tightly around said air tank in tight engagement, said buckle on said shell being capable of quick disconnect for disengagement of said air tank from said shell.

4. The propulsion system attachment of claim 2 in which said air tank receiving boot member is provided with a safety switch which shuts off said propeller motor when said propulsion system attachment becomes disengaged with said air tank.

5. The propulsion system attachment of claim 2 in which said motor power control comprises a speed control switch panel and a power line extending from said propeller motor, a terminal control end of said power line bearing said speed control switch panel being adapted to be disposed within immediate reach of said user, said power line being connected to said quick connect buckle of said cylindrical shell of said air tank receiving boot member, whereby quick disconnection of said propulsion system attachment can be effected by pulling said power line for rapid jettison by said user.

6. The propulsion system attachment of claim 1 which further comprises a buoyancy bag member, said bag member being adapted to be selectively inflated and deflated by said user, whereby a buoyancy effect can be created to counteract a weight of said propulsion system attachment in the water.

7. The propulsion system attachment of claim 6 in which an air line in communication with said buoyancy bag member is provided for inflation of said bag member by said user, said air line having a valve for selective deflation of said bag member.

8. The propulsion system attachment of claim 6 in which said buoyancy bag member is disposed on said propulsion system attachment such that it contacts a lower back area of said user, whereby said user's body can be maintained in a relatively horizontal orientation upon inflation of said bag member.

9. The propulsion system attachment of claim 1 in which said propeller motor is adapted to rotate in a plane about its axis of connection to said air tank receiving boot member, at least one spring member being connected to said propeller motor to maintain said motor in alignment with said air tank, said spring member having a sufficient tensioning load to urge said propeller motor back into alignment when displaced from alignment, whereby said motor propeller facilitates turning when said user maneuvers underwater.

10. The propulsion system attachment of claim 1 in which it is capable of conversion into a hand held unit, said propulsion system attachment further comprising a plug member being adapted to be received within said air tank receiving member, said plug member having handle members attached thereto.

11. A propulsion system for underwater use, said propulsion system comprising:

an air tank, a propeller motor, a motor control, and a belt support strap, said propeller motor being mounted to said air tank, said motor control regulating said propeller motor to effect propulsive movement underwater, said belt support strap serving to attach said propulsion system onto a user, said propulsion system further comprising a buoyancy bag member, said bag member being adapted to selectively inflated and deflated by said user, whereby a buoyancy effect can be created to counteract a weight of said propulsion system attachment in the water.

12. An underwater propulsion system unit, said propulsion system unit comprising:

a propeller motor, a power supply for said motor, a motor power control, and a cylinder member receiving boot member, said power supply being mounted to said cylinder member receiving boot member, said propeller motor being non-collinearly mounted on an adjacent side of said cylinder receiving boot member, said cylinder member receiving boot member being adapted to engage a cylinder member approximating an interior dimension of said cylinder receiving boot member, said motor power control adapted to regulate said propeller motor, whereby a propulsive movement can be effected on said engaged cylinder member when said unit is underwater.

13. The propulsion system unit of claim 12 in which said cylinder member receiving boot member comprises a cylindrical shell, a slit being disposed in a wall of said shell such that said shell is capable of being slightly pulled apart to receive said cylinder member therein, said shell having a quick connect buckle to draw said wall of said shell tightly around said cylinder member in tight engagement.

14. The propulsion system unit of claim 12 which further comprises a buoyancy bag member, said bag member being adapted to be selectively inflated and deflated, whereby a buoyancy effect can be created to counteract a weight of said propulsion system unit in the water.

15. A propulsion system attachment for mounting on a scuba air tank, said propulsion system attachment comprising:

an air tank receiving boot member, a propeller motor, a power supply for said motor, a motor power control, and a belt support strap, said air tank receiving boot member being adapted to fit onto said air tank, said propeller motor being mounted to said air tank receiving boot member such that a propulsion system is created, said propeller motor being non-collinearly positioned at an adjacent side of said air tank receiving boot member, said motor power control adapted to regulate said propeller motor to effect propulsive movement underwater, said belt support strap serving to attached said propulsion system onto a user.

16. The propulsion system attachment of claim 15 in which said air tank receiving boot member is removeably attached to said air tank, and said belt support strap has a quick connect buckle, whereby said propulsion system attachment is capable of being rapidly jettisoned by said user.

17. The propulsion system attachment of claim 16 in which said air tank receiving boot member comprises a cylindrical shell, said shell having a circumference slightly less than that of said air tank, a slit being disposed in a wall of said shell such that such shell is capable of being slightly pulled apart to receive said air tank therein, said shell having a quick connect buckle to draw said wall of said shell tightly said air tank in tight engagement, said buckle and said shell being capable of quick disconnect for disengagement of said air tank from said shell.

* * * * *